United States Patent [19]

Altenschöpfer et al.

[11] Patent Number: 4,564,535

[45] Date of Patent: Jan. 14, 1986

[54] PRODUCT AND PROCESS FOR SCENTING PACKAGING MATERIALS

[75] Inventors: Theodor Altenschöpfer, Düsseldorf; Walter Giesen, Haan; Klaus Schumann, Erkrath; Benno Streschnak, Krefeld, all of Fed. Rep. of Germany

[73] Assignee: Henkel Kommanditgesellschaft auf Aktien, Duesseldorf, Fed. Rep. of Germany

[21] Appl. No.: 459,135

[22] Filed: Jan. 19, 1983

[30] Foreign Application Priority Data

Jan. 22, 1982 [DE] Fed. Rep. of Germany ..... 3201941

[51] Int. Cl.[4] ..... A61K 7/46; C11B 9/00; B05D 5/00; B05D 3/12

[52] U.S. Cl. ..... 427/285; 252/522 A; 427/288; 427/286; 427/369; 428/452

[58] Field of Search ..... 252/522 R, 522 A; 427/284, 285, 384, 288, 428, 286, 369; 206/823; 229/6 R; 428/452, 453

[56] References Cited

U.S. PATENT DOCUMENTS

| | | | |
|---|---|---|---|
| 2,933,431 | 4/1960 | Sperouleus | 424/28 X |
| 3,619,280 | 11/1971 | Scheuer | 427/395 X |
| 4,068,614 | 1/1978 | Kopachkov | 118/6 |
| 4,394,127 | 7/1983 | Melville | 252/522 X |

FOREIGN PATENT DOCUMENTS

| | | |
|---|---|---|
| 4463 | 10/1979 | European Pat. Off. . |
| 819846 | 11/1951 | Fed. Rep. of Germany . |
| 870242 | 3/1953 | Fed. Rep. of Germany . |

OTHER PUBLICATIONS

European Search Report #EP 83 10 0271.

*Primary Examiner*—Michael R. Lusignan
*Attorney, Agent, or Firm*—Ernest G. Szoke; Henry E. Millson, Jr.; Mark A. Greenfield

[57] ABSTRACT

Process and product for scenting packaging materials by direct application of perfumes to said materials, whereby well controlled perfume application is achieved without spotting or loss of perfume. The present process is accomplished by formulating the perfume prior to application into a paste and then applying the paste to the package materials.

12 Claims, 3 Drawing Figures

PRODUCT AND PROCESS FOR SCENTING PACKAGING MATERIALS

BACKGROUND OF THE INVENTION

This invention relates to a process for scenting packaging materials by direct application of perfumes to such materials. It also relates to a perfumed paste for the perfuming of such packaging materials.

Detergents and cleaning products are usually offered for sale in scented form. As a rule, the perfumes are usually contained within the product so that the consumer is exposed to the fragrance when he first opens the package as well as during continued use of the product.

Perfumes, however, are unstable to a large number of constituents present in detergents and cleaning products. This applies, for example, to chlorine in hypochlorite form or chlorine bound to organic chlorine-containing compounds such as sodium dichloroisocyanurate and trichloroisocyanuric acid. Even perborate in combination with bleach activators can negatively influence the stability of perfumes. These disadvantages can be alleviated, as disclosed in European Patent Application No. 4463, by scenting the packaging material, in particular the cartons used for packaging. Direct contact between the perfumes and the interfering contents will then not occur. It is preferable to apply the perfumes to the inner upper portion of the box in order to impregnate the cardboard material.

However, it has been demonstrated that in practice a number of cartons only slowly absorb the perfumes when applied either in the form of droplets or as sprays. The perfumes will be absorbed in "cone-shaped" form thereby leaving visible spots on the carton. In addition, the scented mist arising from the spray results in a great deal of waste, thereby rendering the process less economical and subjecting the workers in the surrounding areas to odor irritation. Finally, current processes do not allow for distribution of the perfumes as is desirable from a visual standpoint.

DETAILED DESCRIPTION OF THE INVENTION

Figure 1:
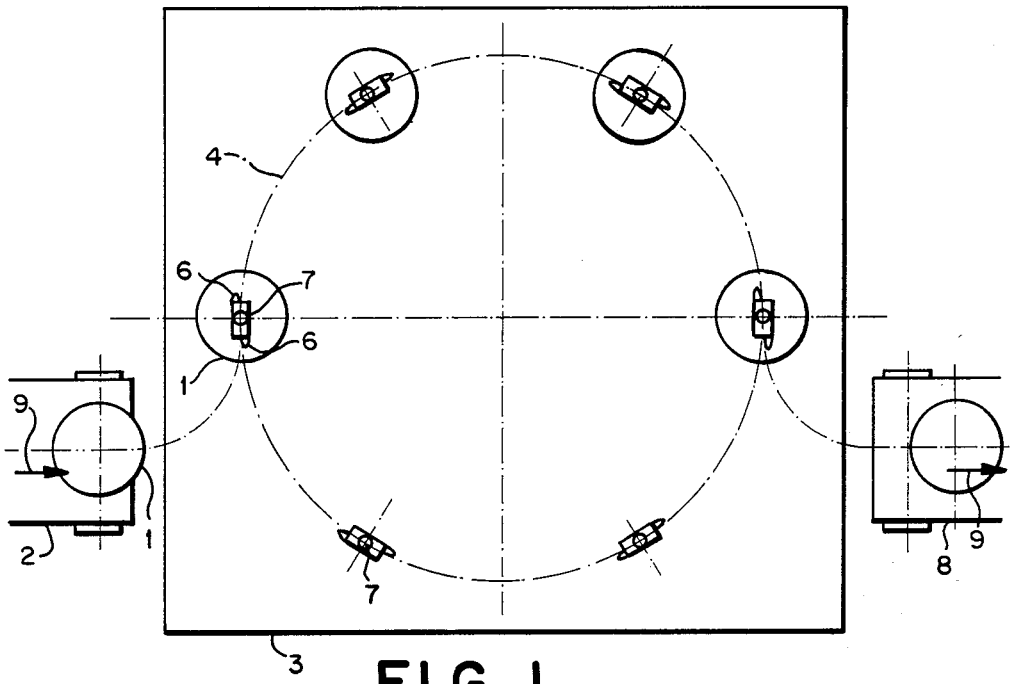
FIG. 1 shows a horizontal sectional view of the equipment used for carrying out the process of the invention.

This invention has as its object a process for scenting packaging materials that will insure that the scented substances are properly distributed without too much loss of scent or spotting. The solution to the latter problems in accordance with the invention consists of formulating the perfume as a highly viscous paste, and then applying it to the packaging material in paste form. The perfume, in accordance with this invention, is preferably mixed with a carrier or gelling agent, thereby producing a paste endowed with thixotropic properties.

In accordance with the present invention, pure, liquid, low viscosity perfumes are not applied to the packaging material, but rather scented pastes of higher viscosity that are preferably the packaging material without spotting and results in a minimal endowed with thixotropic properties. This permits scenting loss of perfume.

Silicic acid or organic modified laminar silicates are preferably used as the carriers or gelling agents. These materials are also used in other connections to solidify or thicken liquid or soft materials (See German patents Nos. 819 846 and 870 242) and as agents for the preparation of pastes with thixotropic properties of known materials. They are added to perfumes in the present invention preferably in amounts of from about 1 to about 20%, more preferably from about 2.5 to about 15% by weight, based on the weight of the final scented paste composition.

The addition of carrier materials such as silicic acid or laminar silicates to perfumes is best accomplished by using stirring equipment with great shearing strength. The final viscosity of the resulting scented pastes depends on the ratio of perfume to carrier material. For additional viscosity modifications, solvents with a polarity different from that of the perfumes can be added. The term "perfume" as used in this invention encompasses not only individual perfumes but also combinations of perfumes. The same applies to the terms "silicic acid" and "laminar silicate."

The scented paste compositions of the invention comprise a perfume and a gelling agent incorporated therein to promote paste formation as well as to increase the viscosity of the scented material. It is preferred that the scented pastes of the invention be endowed with thixotropic properties, and contain, as the gelling agent, silicic acid or an organically modified laminar silicate, preferably in the ratios given above.

As stated above, the scented pastes of the invention are used for scenting packaging materials by application of the pastes thereto. It has been found that the gelling agents, and in particular the laminar silicates, do absorb the perfumes, and through the interaction of perfume on the one hand with the gelling agent or carrier on the other hand, delayed discharge of perfume is attained. This results in the significant advantage of having the perfume linger for longer periods of time on packaging materials coated with the scented pastes than with prior art perfume compositions.

The preferred gelling agents are pyrogens, i.e. silicic acids obtained by flame hydrolysis of silicon tetrachloride in an oxyhydrogen flame. Such a pure and highly dispersed silicic acid of a defined particle size and chemical composition can be purchased from the Degussa Company, under the "AEROSIL 200" label. This material which was developed especially for its thixotropic, thickening, or strengthening properties, has a surface area of about 200 $m^2/g$. For the scented pastes of the invention, organically modified laminar silicates are used successfully as gelling agents, for example, those available under the trade name of "BENTONE 34", a dimethyl-dioctade-cylammonium montmorillonite from Titangesellschaft mbH.

Figure 2:
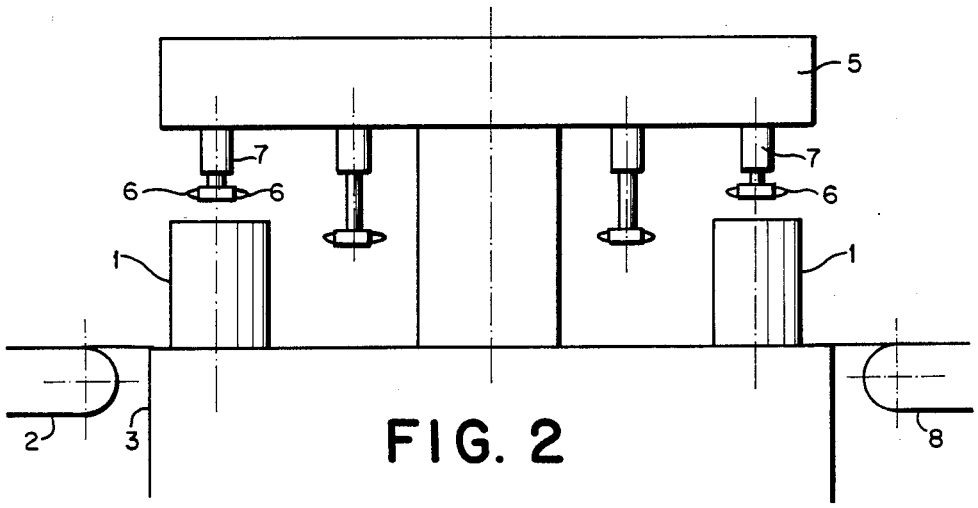
FIG. 2 shows a vertical sectional view of said equipment.

In accordance with the process of the invention, the scented pastes are applied to the actual packaging material either by spraying, using a spreading device, or by painting. For large scale applications, the scented paste for scenting cardboard containers is preferably applied as shown in FIGS. 1 and 2. For these figures, cardboard containers 1 with their open side facing upward are conveyed via transport mechanism 2 to machine 3, and from there continuously transported in a circular path 4. There, perfuming apparatus 5 (FIG. 2) containing dual-nozzles 6 and application apparatus 7 is activated so that dual nozzles 6 are lowered a controlled amount into said containers 1, and the application of the scented pastes is carried out through dual-nozzles 6, which are oriented so that the nozzles are at 180° from each other. In this manner, the scented paste is applied to the walls of cardboard containers 1 at a pressure of 1 to 3 bar, using a circular motion of 180°, thereby forming a narrowly defined scented paste ribbon over the entire inside area of the container. After continuous application of the paste via machine 3, application apparatus 7 is removed from cardboard containers 1, and the latter are transported further and delivered to conveyor belt 8. The direction of movement of the system is shown by arrows 9. Obviously, the circular motion can also be imparted by making dual-nozzle 6 stationary, and rotating cardboard containers 1.

Figure 3:
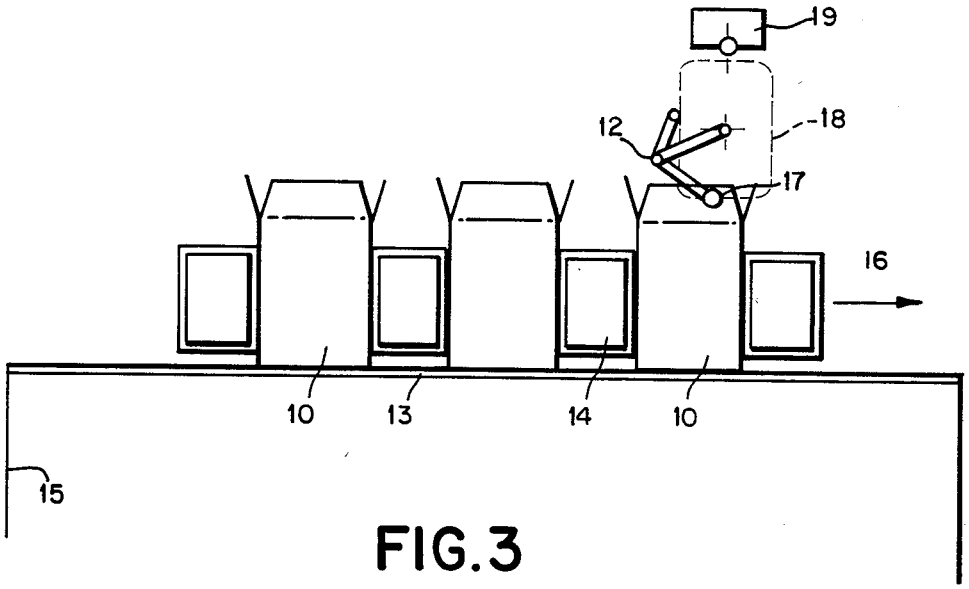
FIG. 3 shows a side view of equipment designed for use with square and rectangular boxes.

Perfuming of boxes, especially square cartons, can also be carried out in a similar automatic fashion. As shown in FIG. 3, boxes 10 with their closure flaps 11 in an open position are moved toward applicator device 12 by means of a continuous or intermittent transport apparatus with floor guide 13, and a conveyor chain 14, which are part of filling installation 15. The back closure flaps 11 of boxes 10 which are moving in direction 16 thereby come into contact with application roller 17 coated with scented paste, and the boxes 10 move on. In so doing, application roller 17 moves in a curve 18 in such a manner that it first dips into box 10 as shown, then reemerges from box 10 along the back closure flap 11, and then moves along to receptable 19 filled with scented paste, where it is again replenished with paste, and subsequently dips anew into the next box 10. This process is very efficient, especially when coupled to the main drive shaft (not shown) of the packaging machine.

The following examples are given for illustration purposes only and not to limit the invention.

EXAMPLES 1-8

Examples of scented pastes with the desirable properties of the invention and with the perfume designations A=citrus and B=apple are set forth in Table I below.

TABLE I

| Example | Perfume Parts by Weight | | BENTONE 34, Parts by Weight | AEROSIL 200, Parts by Weight | Viscosity, mPas |
|---|---|---|---|---|---|
| 1 | 85 | A | 15 | — | 6000 |
| 2 | 90 | A | 10 | — | 430 |
| 3 | 95 | B | 15 | — | 3100 |
| 4 | 87.5 | B | 12.5 | — | 800 |
| 5 | 92.5 | A | — | 7.5 | 5800 |
| 6 | 93.5 | A | — | 6.5 | 2850 |
| 7 | 93.5 | A | — | 6.5 | 5100 |
| 8 | 94.5 | B | — | 5.5 | 1050 |

The viscosity values given in the table were determined by the Epprecht method. A stirring time of three minutes was utilized for Examples 1 through 4 and 7 using an Ultra Turrax stirrer, and for Examples 5, 6 and 8 using a simple winged stirrer with 250 rpm.

EXAMPLE 9

Vertically positioned cylindrical containers made of cardboard, having a diameter of 225 mm and a height of 220 mm, are brought under rotating spray nozzle using the method described above for FIGS. 1 and 2. At a pressure between 1 and 2 bar, 0.5 g of perfume of Scent A (lemon) is sprayed onto a 360° segment of the containers 2 cm below the container rim. Due to the fluidity of the perfume material and the additional misting of the perfume material, the desired placement of the perfume material onto the cardboard could not be achieved. In addition, odor pollution of the surrounding areas is substantial.

EXAMPLE 10

Vertically positioned cylindrical containers composed of cardboard, having a diameter of 225 mm and a height of 220 mm, are moved along under rotating nozzles using the method described above for FIGS. 1 and 2. At a pressure of 1.5 bar, 0.6 g of the scented paste of Example 1 of Table I above is applied. A narrowly defined scented paste layer is formed at the circumference of the upper drum rim. The perfume does not dry, and is locally contained and absorbed by the cardboard. No excessive scent is present in the manufacturing installation.

EXAMPLE 11

A container composed of cardboard is treated as in Example 10, using 0.5 g of the scented paste of Example 8 of Table I above, at a spray pressure of 1.0 bar. The application is carried out as in Example 10, with the same favorable results. The surrounding areas are not excessively burdened with scent.

What is claimed is:

1. A process for scenting a packaging container comprising applying to a section of the packaging container a scented paste comprising a perfume and a thickening quantity of a gelling agent wherein the paste has thixotropic properties.

2. A process in accordance with claim 1 wherein the paste is formulated prior to use by blending perfume with at least one thickening agent in stirring equipment having high shearing strength.

3. A process in accordance with claim 1 wherein the paste contains perfume and a thickening quantity of silicic acid.

4. A process in accordance with claim 1 wherein the paste contains perfume and a thickening quantity of an organically modified laminar silicate.

5. A process in accordance with claim 3 wherein the silicic acid is present in the paste in an amount of from about 1 to about 20% by weight, based on the weight of the paste.

6. A process in accordance with claim 5 wherein said amount is from about 2.5 to about 15% by weight.

7. A process in accordance with claim 4 wherein the laminar silicate is present in the paste in an amount of from about 1 to about 20% by weight, based on the weight of the paste.

8. A process in accordance with claim 7 wherein said amount is from about 2.5 to about 15% by weight.

9. A process in accordance with claim 1 wherein said paste is applied to the packaging container at a pressure in the range of from about 1 to about 3 bar.

10. A process in accordance with claim 1 wherein said paste is applied in a narrowly defined paste ribbon to the packaging container.

11. A process in accordance with claim 1 wherein the packaging container is a box with closure flaps, and the paste is applied to the inside of one closure flap thereof.

12. A process in accordance with claim 11 wherein said paste is applied to the closure flap by means of a roller containing the paste thereon.

* * * * *